United States Patent [19]

Chiang

[11] 4,250,590

[45] Feb. 17, 1981

[54] COVER PROTECTED BRUSH WITH COLLAPSIBLE BRISTLES

[76] Inventor: Sherman H. Chiang, 3rd Fl., 51, Lane 214, Chien Kuo N. Rd., Taipei 104, Taiwan

[21] Appl. No.: 69,114

[22] Filed: Aug. 23, 1979

[51] Int. Cl.[3] ..... A46B 3/00; A46B 7/00

[52] U.S. Cl. ..... 15/203; 132/11 R

[58] Field of Search ..... 132/11 R, 102, 103; 15/203, 205, 195

[56] References Cited

U.S. PATENT DOCUMENTS

| | | | |
|---|---|---|---|
| 909,273 | 1/1909 | Yorks | 15/203 |
| 1,189,698 | 7/1916 | Keating | 15/203 |
| 2,792,582 | 5/1957 | Gray | 15/203 |
| 3,086,236 | 4/1963 | Anonsen | 15/203 |
| 3,651,532 | 3/1972 | Wettburg | 15/186 |
| 4,103,387 | 8/1978 | Anetseder, Jr. | 15/203 |
| 4,137,596 | 2/1979 | Carlson et al. | 15/203 |

FOREIGN PATENT DOCUMENTS

| | | | |
|---|---|---|---|
| 54534 | 11/1890 | Fed. Rep. of Germany | 15/203 |
| 171666 | 12/1934 | Sweden | 15/203 |

*Primary Examiner*—Paul J. Hirsch

[57] ABSTRACT

A cover protected brush with collapsible bristles, more specifically a collapsible brush for ladies, characterized in that the bristles of the brush can be collapsed and protected with a cover so as to reduce its volume and make it easier for a lady to carry in her handbag. The mirror affixed to the cover makes the brush serve also as a handle mirror.

2 Claims, 7 Drawing Figures

COVER PROTECTED BRUSH WITH COLLAPSIBLE BRISTLES

SUMMARY OF THE INVENTION

This invention relates to a cover protected brush with collapsible bristles, more particularly to a collapsible brush used by ladies, characterized in that the bristles can be collapsed and protected with a cover so as to reduce its volume and make it easier to carry in a lady's handbag. Moreover, as a mirror is affixed to the cover, therefore, it can also be used as a handle mirror. When the cover is removed, the bristles will erect upright automatically and serve the purpose of a brush.

Man is endowed with an aesthetic sense. He must keep himself neat and clean so as to create a favorable image in the minds of his fellow men. Hair is on a prominent part of one's body. It certainly should be properly taken care of. This is especially the case with a lady. Consequently, a brush becomes an important article to her. And as her hair is usually long and dried, a bristle-teethed brush is the kind of comb most suitable and useful to her. However, because the bristles of the conventional type brush are fixed, it is rather inconvenient to carry and it also occupies considerable room in a lady's handbag. This is the major defect of conventional bristle-teethed brush. A cover-protected brush with collapsible bristles would remove this defect. And when a mirror is affixed to the cover, the brush can also be used as a mirror. Is it not a wonderful idea to serve two purposes with one article?

With this idea in mind, the inventor, after many attempts and tests to realize it, is finally able to present this invention.

The main object of this invention, as stated above, is to remove the major defects of the conventional bristle brush and to provide a construction which collapse the bristles of the brush to reduce its volume.

Another object of this invention is to affix a mirror to the cover so that when the bristles of the brush collapsed and the protective cover is put on, the brush can be used as a handle mirror. Thus, the same item is made to serve two purposes.

EXPLANATION OF DRAWINGS

The features, objects and construction of the brush according to this invention will now be described in detail with the accompanying drawings, in which.

DETAIL DESCRIPTION OF THE INVENTION

As the figures show, this invention, the cover-protected brush with collapsible bristles a brush base-handle, a rotatable (movable) teeth-bed (20), a perforated rubber covering (30), a plurality of bristles (40), and a protective cover (50).

Figure 1:
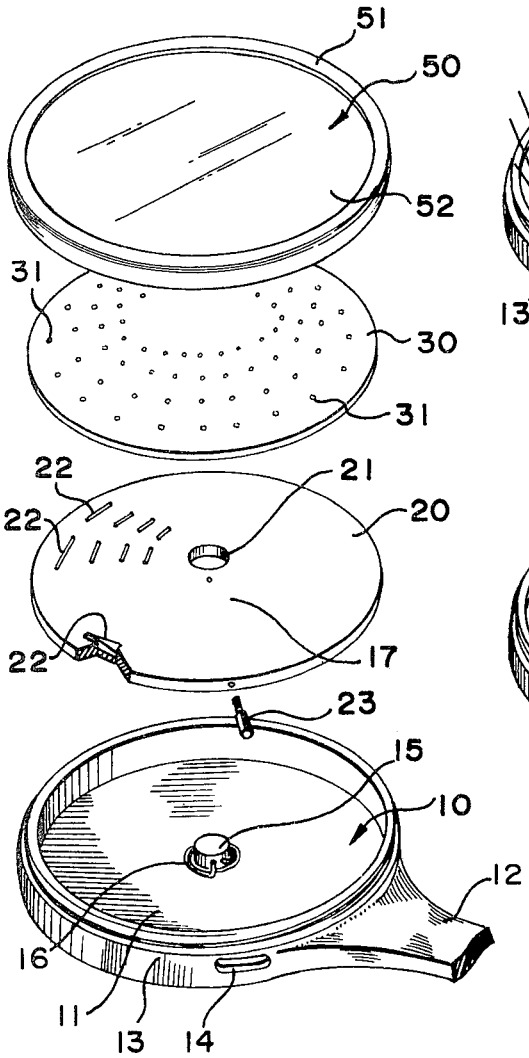
FIG. 1 is an exploded, perspective view of a first embodiment of the cover protected brush with collapsible bristles of this invention.
Figure 2:
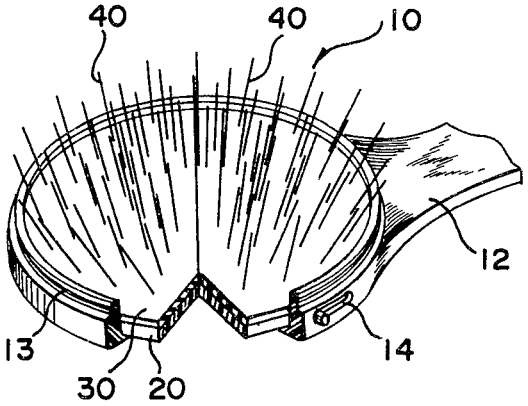
FIG. 2 is a perspective, partially sectional view of the brush shown in FIG. 1 in its assembled condition, with the cover removed.
Figure 3:
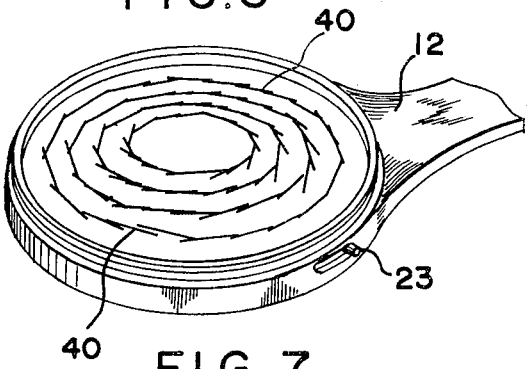
FIG. 3 is a perspective view of the brush shown in FIG. 1 in its assembled condition, when the bristles are in collapsed state.

The brush base-handle (10), as shown in FIG. 1 through FIG. 3 of the first embodiment of the invention, is a solid piece consisting of the base (11) and the handle (12). The base has a wall (13) around it and on the wall at the left side near the handle an opening (14) is provided. At the center of the walled base stands a pivot post (15) on which a spring (16) is placed. One end of spring is attached to the pivot post and the other end is fastened to a small hole (17) on the rotatable teeth-bed (20) near the center hole (21).

The rotatable teeth-bed is a round plate, and at its center a hole (21) is provided therein so that it can fit onto the pivot post (15). The rotatable teeth bed is provided with many small groove holes (22) for the bristles. The length of each groove on the circle is longer than the length of each groove hole on the next circle inside it. However, the length of each groove hole on the innermost circle has still to be long enough to let the bristle collapse into it completely. Further, in order to lay out the positions for the bristles to collapse all the groove holes must be arranged with a certain angle in relation to the center so that when the bristles are collapsed they will collapse orderly and will not disturb one another as shown in FIG. 3. On the edge of the rotatable teeth-bed a protruding key (23) is fixedly provided. When the brush is assembled, the key will protrude out from the opening (14) on the base-handle (10). The bristles (40) of the brush can be collapsed by pushing the key along the opening on the base wall to turn the rotatable teeth-bed.

The perforated rubber covering (30) is made of elasticity-rich rubber sheet. The holes (31) are provided to correspond to those groove holes (22) on the rotatable teeth-bed so that, when a brush is assembled, the bristles can go through both these holes (22 and 31).

The bristle (40) is shaped like a solid-headed pin. When planted, it goes through the groove hole (22) on the rotatable teeth-bed (20) and the hole (31) on the rubber covering (30) and erects upright to serve the intended purpose of arranging and untangling hair.

The protective cover (50) has a rim (51) around it. The rim is placed around the wall (13) of the base-handle (10) when the cover is put on the brush, and serves as a joiner of the cover to being capable of engaging with the base either by screw-thread or by close fit. As this is a simple matter, therefore, it is not described further here. The surface inside the cover is smooth, therefore, when it is put on the brush, it will not disturb the collapsed bristles. A mirror (52) is affixed to the external surface of the cover. Thus, the brush can also be used as a handle mirror.

Figure 7:
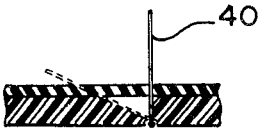
FIG. 7 is a cross sectional view of the groove hole shown in FIGS. 1 and 4, showing the bristle collapsed from its erecting position.
Figure 4:
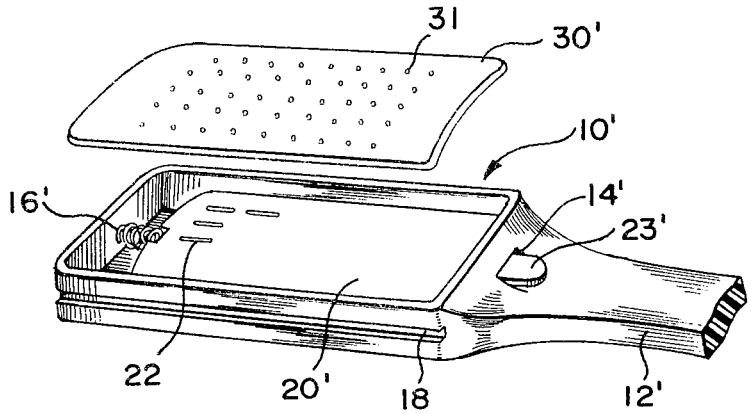
FIG. 4 is a partly disassembled perspective view of a second embodiment of the cover protected brush with collapsible bristles of this invention.
Figure 5:
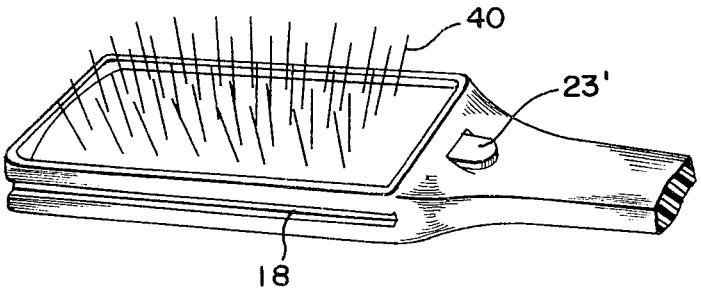
FIG. 5 is a perspective view of the second embodiment of this invention in its assembled condition, with the cover removed.

To assemble the brush, first plant the bristles from the hole beneath the rotatable teeth-bed, then pull the bristles through the groove-holes provided on the bed. Place the rotatable teeth-bed in the base-handle (10), and fix protruding key by way of the opening (14) on the base-handle. Place the rubber covering (30) on the rotatable teeth-bed and let the bristles extend through the holes on the covering. When the protruding key is pushed along the base-handle to turn the rotatable teeth-bed, the bristles will collapse into the groove holes. As shown in FIG. 7, each groove hole is so constructed that the hole wall opposite the groove is vertical while the wall adjoining the groove is inclined. Of course, it is workable only when the direction of the inclined groove holes is opposite against the direction of the motion of the rotatable teeth-bed. The bristles are collapsed when the key is pushed to the end of the opening. The volume of the brush is further reduced by pressing the collapsed bristles with the protective cover. When the protective cover (50) is removed, the recoil force of the spring (16) will turn the bristles-bed to its original position and the teeth will erect upright, the brush is thus ready for use.

Figure 6:
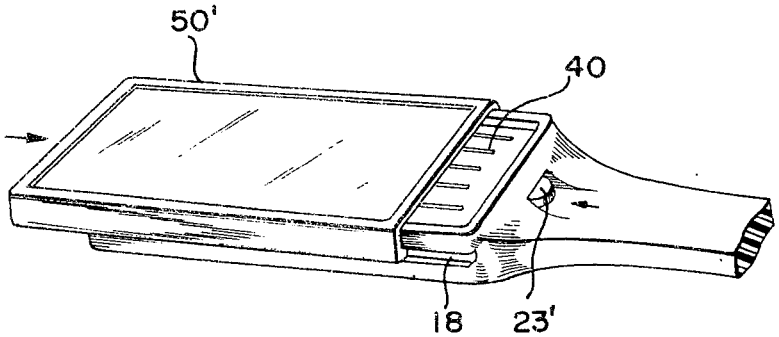
FIG. 6 is a perspective view of the second embodiment of this invention, with the cover being assembled to the brush.

The components and mechanism of the rectangular brush with collapsible bristles are similar to those of the round one. The difference is only in the location of the spring (16') which, in this case, is fixed at the end opposite the handle inside the wall of the base, and the location of the protruding key (23') of the movable teeth-bed (20') which, in this case, is fixed to the edge near the other end and protrudes out from the opening (14') provided on the foot of the base wall near the handle. To collapse the bristles, push forward the protruding key to move the movable teeth-bed to reach the other end of the base wall, the bristles of the brush will collapse toward the direction of the handle. The protective cover (50') may then be assembled, as shown in FIG. 6. When the protective cover (50') is removed, the recoil force of the spring will move the movable teeth-bed to its original position and the bristles will erect upright, thus the brush is ready for use. It may also be noted here that in the rectangular brush both sides of the base-handle are provided with grooves. The grooves 18,18 are used to fix the protective cover. Other constructions are similar to those of the round brush described above.

I claim:

1. A cover protected round brush assembly with collapsible bristles comprising a brush base, an integral handle extending from said brush base forming a solid piece, a rotatable bed mounted on said base, a plurality of groove holes through said bed, said groove holes each having an angled wall, angled in the same direction relative to the center of said bed, bristles mounted through each said groove hole from underneath said bed, said base including a circumferential wall, a slot in said wall, said further including; a pivot post in the center of the base about which a spring is secured at one end to the post, a protruding key mounted on the circumferential edge of said bed, said bed being mounted on said post through a first hole in the center of the bed such that the key extends out through said opening in the wall of the base for movement of the bed and collapsing said bristles, said spring having an other end secured to a second hole on said bed near said first hole, a rubber covering mounted on top of said bed and having a plurality of through holes corresponding to each said groove hole and having each of said bristles extending therethrough, and a protective cover for said assembly mounted and sized such that upon removing said cover, said spring causes rotatable movement of the bed extending said bristles upright.

2. A cover protected rectangular brush assembly with collapsible bristles comprising; a brush base having first and second sides, an integral handle extending from said brush base forming a solid piece, a rectangularly shaped bed mounted on said base, a plurality of groove holes through said bed, said groove holes each having an angled wall, angled in the same direction relative to said handle, bristles mounted through each said groove hole from underneath said bed, said base including a peripheral wall, a slot in said wall, said base and said bed further including means mounting a coil spring between said wall and said bed at a first portion of said wall opposite said handle for biasing said bed away from said wall portion, a rubber covering mounted on top of said bed and having a plurality of through holes corresponding to each said groove hole and having each of said bristles extending therethrough, said bed further comprising a key protruding out of an opening in a second wall portion opposite said first wall portion, said base having an outer groove on each said side, each said groove cooperating with a protective cover slidable over said bristles in such a manner that upon removal of said cover by sliding, said spring causes sliding movement of said bed extending said bristles upright.

* * * * *